United States Patent [19]

Hara

[11] Patent Number: 4,800,729

[45] Date of Patent: Jan. 31, 1989

[54] THERMO-HYGROSTATIC REFRIGERATORS

[75] Inventor: Yasuo Hara, Toyoake, Japan

[73] Assignee: Hoshizaki Electric Co., Ltd., Aichi, Japan

[21] Appl. No.: 57,536

[22] Filed: Jun. 2, 1987

[30] Foreign Application Priority Data

Aug. 27, 1986 [JP] Japan ..... 61-200694

[51] Int. Cl.[4] ..... F25D 17/02

[52] U.S. Cl. ..... 62/185; 62/188; 62/503

[58] Field of Search ..... 62/503, 98, 188, 185; 417/43

[56] References Cited

U.S. PATENT DOCUMENTS 3,068,660 12/1962 Council et al. ..... 62/352 X

FOREIGN PATENT DOCUMENTS 2925830 1/1981 Fed. Rep. of Germany ..... 417/43

0007650 1/1979 Japan ..... 62/503

*Primary Examiner*—William E. Wayner

*Attorney, Agent, or Firm*—Koda and Androlia

[57] ABSTRACT

A thermo-hygrostatic refrigerator has a cabinet defining a storage room for cooling and storing food materials therein, a refrigeration unit composed of a compressor, a condenser, an evaporator and other refrigeration systems, a brine tank storing brine therein and including the evaporator on the bottom thereof, an accumulator connected to the outlet side of the evaporator and having at least one portion immersed in the brine, a cooler mounted within the storage room and operatively connected to the outlet side of the evaporator and having at least one portion immersed in the brine, a cooler mounted within the storage room and operatively connected to the brine tank to circulate the brine therethrough to cool the interior of the storage room, and a sensing device mounted within the brine tank for monitoring presence of brine circulation.

7 Claims, 7 Drawing Sheets

THERMO-HYGROSTATIC REFRIGERATORS

BACKGROUND OF THE INVENTION

1. Field of the Invention

The present invention relates to improvements in a thermo-hygrostatic refrigerator of the type using brine as cooling medium and more particularly, it relates to such a thermo-hygrostatic refrigerator wherein frequent start-stop operations of a compressor in the refrigerator may be avoided to thereby safe power consumption and enhance durability of moving parts. The present invention is also concerned with an improved thermo-hygrostatic refrigerator including means for rapid detection of unusual conditions such as interruption of brine circulation due to pump failure or other malfunctions, and shortage of brine circulation required for cooling the storage room.

2. Description of the prior Art

When perishable foods such as vegetables, fruit, meat and fish (hereinafter referred to as "food materials") are cold stored in a refrigerator for a long period of time, or when frozen food materials are gradually thawed, it is generally necessary to minimize changes in temperature within the refrigerator and control evaporation of moisture from the food materials. In order to meet the requirements, brine-cooled refrigerators, which use brine as cooling medium, have been put to practical use.

FIG. 7 shows an example of such refrigerators using brine as cooling medium. As shown therein, the refrigerator includes a cabinet 1 which defines a storage room 1*a* therein. A cooler 2 is located with the storage room 1*a* through which brine is circulated. A cooling unit section 3 is provided adjacent the storage room 1*a* including a refrigeration unit 10 which is composed of a compressor 4, a condenser 5, a drier 6, a capillary tube 7, an accumulator 8, an inlet pipe 9, etc. Reference numeral 11 designates a brine tank or container for storing brine 12 at a predetermined level. Disposed on the bottom of the brine tank 11 is an evaporator 13 which is connected in flow communication with the refrigeration unit 10 for forcibly cooling the brine 12.

The brine 12 cooled in the brine tank 11 is fed to the cooler 2 through an inlet pipe 17, a circulating pump 14, a discharge pipe 18 and a supply pipe 15 for cooling the air in the storage room 1*a* (hereinafter referred to as "internal air"). After cooling the internal air, the brine 12 is returned to the tank 11 through a feedback pipe 16. This cyclic operation is repeated to maintain the interior of the storage room 1*a* at a desired temperature.

Thus, the refrigerators using brine as cooling medium are capable of circulating a great amount of brine having large specific heat, as compared with ordinary refrigerators using freon gas as a cooling source and therefore, their cooling capacity may be made larger; the brine-cooled refrigerators are suitable to cool and store a great amount of food materials. In addition, temperature differences may be made less between the surface temperature of the cooler in the storage room 1*a* and the internal temperature and hence, moisture in the internal air may be restrained from frosting on the cooler surface, thereby maintaining the interior of the storage room at a high humidity.

In the above described thermo-hygrostatic refrigerator, the brine 12 stored in the brine tank 11 is cooled to a required temperature by the evaporator 13 connected to the refrigeration unit 10, and is supplied to the cooler 2 through the inlet pipe 17, the pump 14, the discharge pipe 18 and the supply pump 15. In the cooler 2, the brine 12 exchanges heat with the internal air and then returns to the brine tank 11. The temperature of the returning brine 12 is raised through the heat exchange and therefore, the temperature of the brine 12 in the tank 11 will also be increased. When the thus heated brine 12 is recirculated through the cooler 2 and is caused to exchange heat with the internal air, the temperature of the internal air will be gradually increased. Therefore, in order to maintain the temperature within a predetermined temperature range, the refrigeration unit 10 has to be reoperated, causing the evaporator 13 to cool the brine 12 in the tank 11 down to the required temperature range. At this point, when the brine 12 is cooled to the required temperature by the evaporator 13, the temperature of the cooler 2 becomes substantially equal to that of the circulating brine 12, thereby lowering the temperature of the internal air. As soon as the internal air is lowered to the required temperature, an internal temperature sensing device (not shown) will be actuated to stop the refrigeration unit 10.

When the refrigeration unit 10 is stopped, the operation of the evaporator 13 to cool the brine 12 will also be stopped. However, the internal air will continue to be cooled by the negative heat value stored in the brine 12 circulated by the pump 14 in motion.

It will be noted that the internal temperature is raised by various factors such as heat entering the storage room 1*a* through a heat insulating material 1*b* of the cabinet 1, heat entering the storage room 1*a* when doors are opened or closed, radiation from food materials stored in the storage room 1*a*, and radiation from a fan FM1 in the storage room 1*a*. When the internal temperature is raised, the temperature of the brine 12 will be gradually increased as the brine 12 exchanges heat with the internal air through the cooler 2. When the internal temperature exceeds an upper limit preset by the temperature sensing device, the refrigeration unit 10 will be reoperated by a signal from the sensing device causing the evaporator 13 to resume its cooling operation for the brine 12. In this way, the refrigeration unit 10 is operated when the internal temperature exceeds the upper set limit, and is stopped when the internal temperature falls below the lower set limit. By the repeated restart-stop operations, the internal temperature may be maintained within the predetermined temperature range.

As mentioned above, such thermo-hygrostatic refrigerators are designed so that the brine 12 in the tank 11 is circulated even when the refrigeration unit 10 is shut down, thereby causing the internal temperature to increase gradually by the use of negative heat value stored in the brine 12. However, if the amount of brine 12 stored in the tank 11 is small, the sum of heat entering the storage room may not be compensated by the negative heat value of the brine 12. This means that the interval is short in which the refrigeration unit 10, which has been shut down, may be reoperated, or in other words, the operation and stopping cycle of the refrigeration unit 10 is frequent, which may lead to shorter service life and higher failure rate of the compressor and other components. Further, every time the compressor 4 starts up, an excessive current flows thereinto, increasing power consumption.

In order to overcome these problems, it is possible to prolong the shutdown time of the refrigeration unit 10 by increasing the capacity of the brine tank 11, that is by increasing the amount of brine 12 to be stored in the tank 11, so that the negative heat value may be greater than the sum of entering heat and other heats. However, the use of a larger tank 11 renders the refrigerator itself larger, requiring a larger installation area and increasing manufacturing cost. In addition, the use of a larger tank 11 without increasing the external dimensions of the refrigerator tends to reduce the effective area of the storage room 1*a*, which in turn reduces the amount of food materials to be stored.

Further, the thermo-hygrostatic refrigerators are used generally for business purposes since they have a large cooling capacity, and in many cases a great deal of food materials are stored in the storage rooms. However, in case that the brine circulation is impossible or the brine amount is insufficient in the brine circulating pipelines for certain reasons such as, for example, failure of rotating parts of the pump and broken wire of the motor coils, the cooling operation in the storage room becomes impossible, which unusually increases the internal temperature. The stored food materials will then be deteriorated or rotten, causing great damages to the user.

In the event that cooling is not effected in the storage room, the prior art has proposed the use of a thermistor or the like which detects an unusual increase in the internal temperature and which actuates warning devices such as a lamp to warn nearby personnel of the unusual condition. However, such sensing means is likely to respond to a temperal temperature increase during defrosting operation and/or a temporal increase in the internal temperature due to frequent opening and closing of the doors, and it has sometimes issued erroneous warnings. For this reason, the sensitivity of such warning devices is set generally at a lower temperature, but in many cases, it may be rather late for the warning device to operate at the set point temperature. Specifically, when the warning device actually operates, the stored food materials may have already been deteriorated or rotten, suffering great damages.

The prior art has also proposed to electrically sense the presence of brine circulation by sensor elements disposed adjacent the brine circulation pipeline. However, the sensor, which is contiguous to the brine pipeline, tends to produce dew due to temperature differences from the ambient temperature. Under the influence of such moisture, malfunction and/or failure will result. Further, a larger space has been required to mount the sensor.

SUMMARY OF THE INVENTION

It is, accordingly, an object of the present invention to provide a novel thermo-hygrostatic refrigerator wherein frequency of start-stop operations of the refrigeration unit may be reduced through employment of a small-sized brine tank.

It is another object of the present invention to provide reliable, less malfunction, less failure means for rapid detection of reduction or interruption of the brine circulation which might be caused from various factors.

These and other objects of the invention are accomplished by a thermo-hygrostatic refrigerator which comprises a cabinet defining a storage room for cooling and storing food materials therein; a cooling unit section disposed adjacent the storage room of the cabinet, the cooling unit section including a refrigeration unit composed of a compressor, a condenser, decompression means and other refrigeration systems and including a brine tank storing brine therein and incorporating an evaporator connected to the refrigeration unit; a cooler mounted within the storage room and operatively connected to the brine tank to circulate the brine therethrough to cool the interior of the storage room; and an accumulator connected to the outlet side of the evaporator disposed in the brine tank, the accumulator having at least one portion immersed in the brine.

Preferably, a solenoid valve is disposed in the pipeline system connecting the condenser with the decompression means, and is adapted to open during operation of the refrigeration unit and to close during shutdown of the refrigeration unit.

In an alternative form of the invention, a sensing device is mounted within the brine tank for monitoring presence of brine circulation.

The present invention will become more fully apparent from the claims and description as it proceeds in connection with the drawings.

DETAILED DESCRIPTION OF THE PREFERRED EMBODIMENTS

Figure 7:
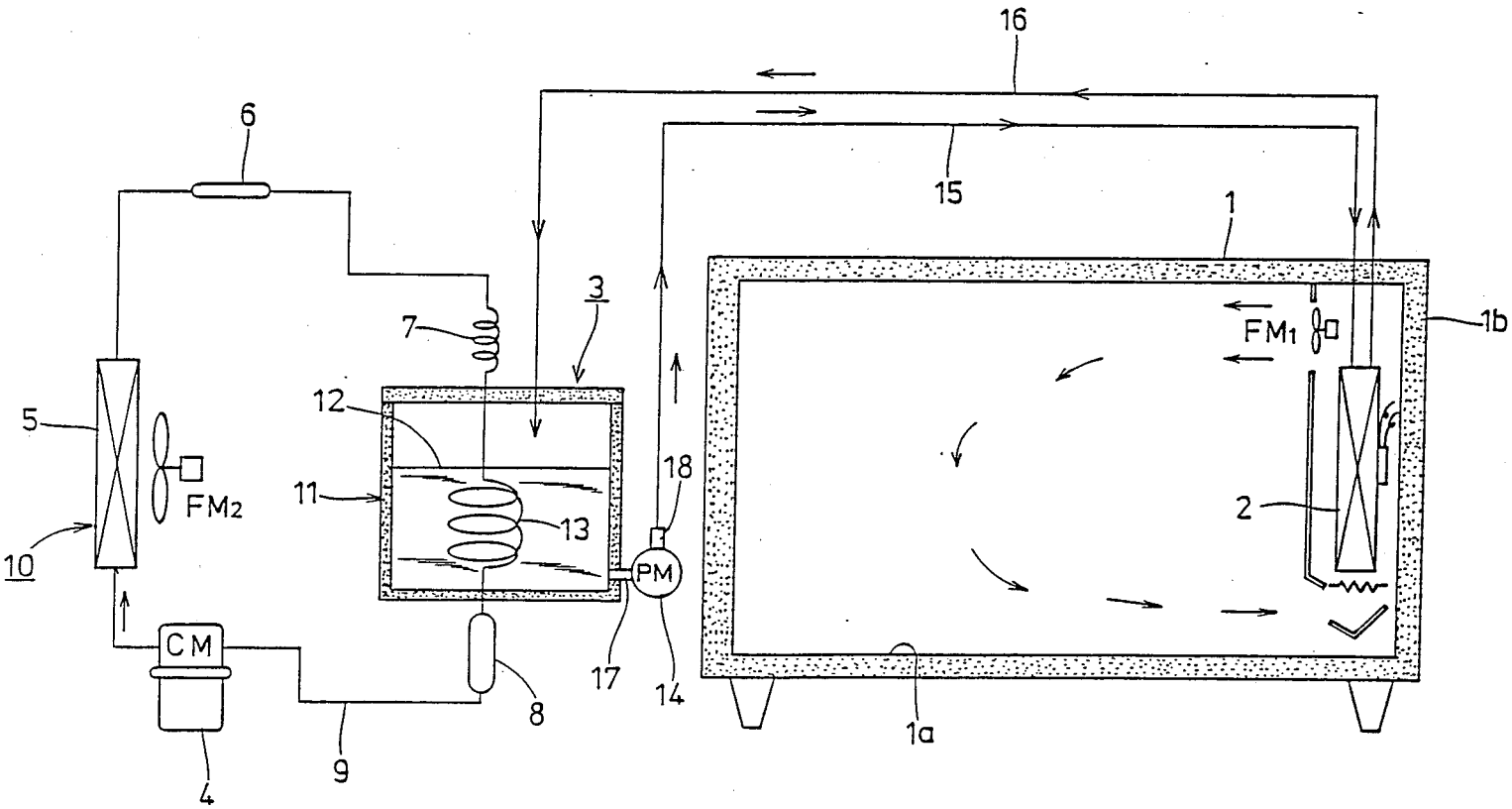
FIG.7 PRIOR ART
FIG. 7 is a schematic vertical sectional view of a thermo-hygrostatic refrigerator of the prior art.

A thermo-hygrostatic refrigerator according to the present invention will now be described with reference to FIGS. 1 to 4. All parts are numbered to correspond to similar parts of FIG. 7.

Figure 1:
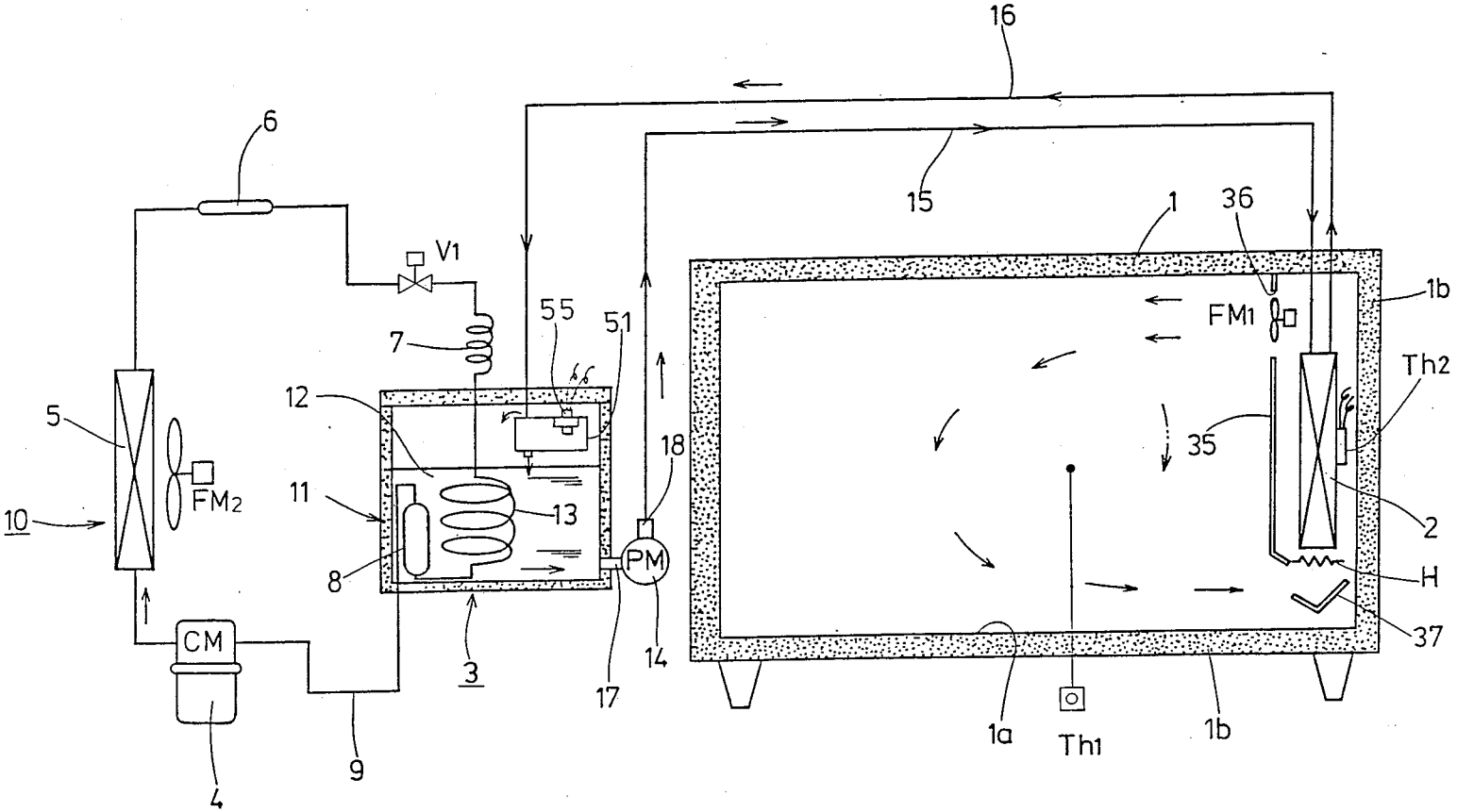
FIG. 1 is a schematic diagram illustrating the pipeline connection of a brine circulating circuit and a cooling system incorporated in a thermo-hygrostatic refrigerator according to a preferred embodiment of the invention.
Figure 2:
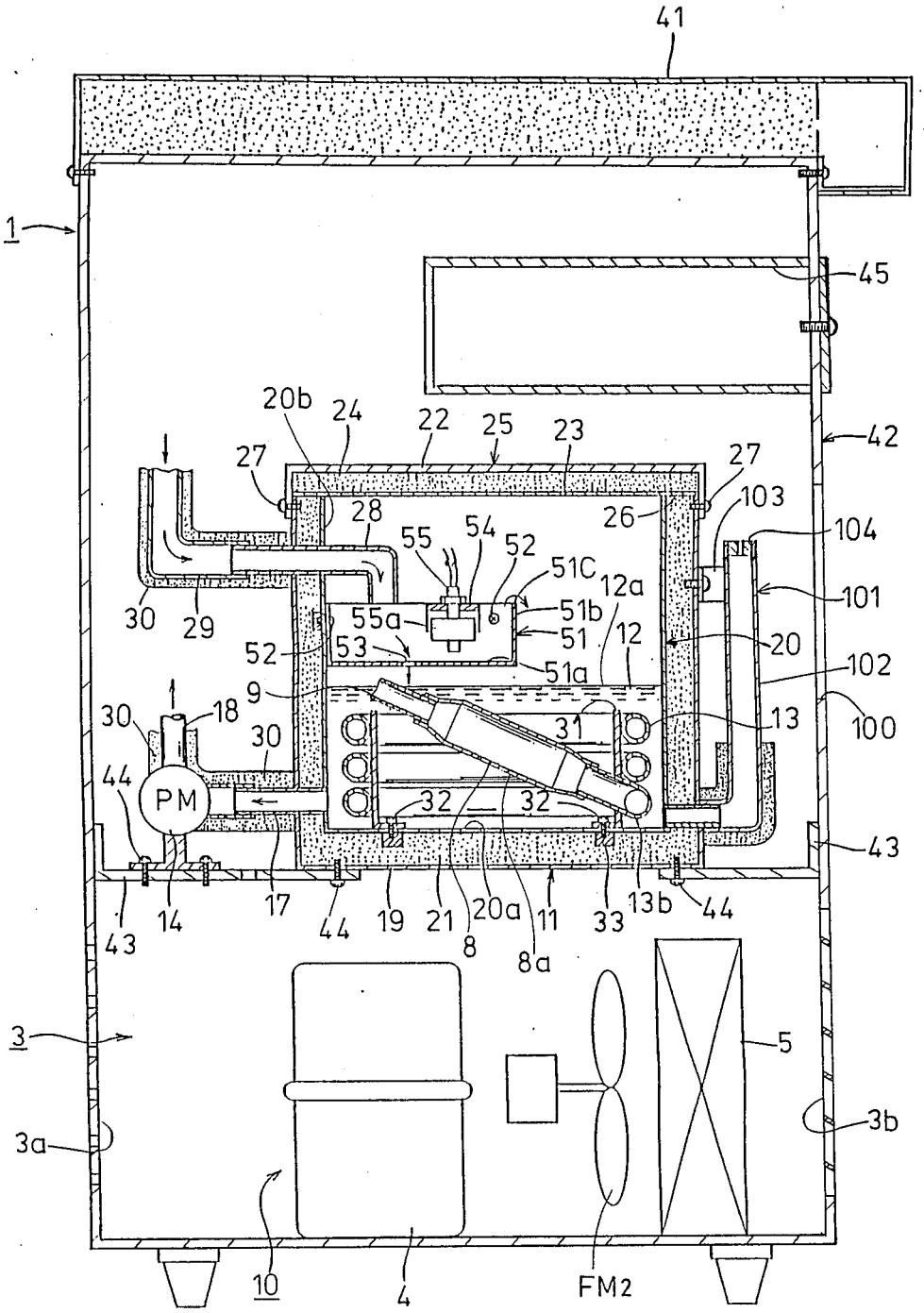
FIG. 2 is a vertical sectional view illustrating the general arrangement of a cooling unit section used in the thermo-hygrostatic refrigerator of the invention.

Referring particularly to FIGS. 1 and 2, the refrigerator of the present invention includes an elongated cabinet 1 which defines a storage room 1*a* therein for storing and cooling food materials. Meat insulating material 1*b* is filled between the cabinet 1 and the storage room 1*a*. The cabinet 1 also has a cooling unit section 3 adjacent the storage room 1*a* through a partition (not shown). The top of the cabinet 1 has a table board or ceiling board 41 extending over the storage room 1*a* and the cooling unit section 3.

As shown in FIG. 2, the cooling unit section 3 comprises a housing which defines a vertically extending elongated space therein. The housing has a front opening which may be covered by a removable cover 42. The cooling unit section 3 also has on the bottom thereof a refrigeration unit 10 which includes several components such as a compressor 4, a condenser 5, a fan motor FM2, a drier 6, a solenoid valve V1, a capillary tube 7, and an inlet pipe 9 (FIG. 1).

A brine tank 11 is mounted within the cooling unit section 3 generally above the refrigeration unit 10. Specifically, as shown in FIG. 2, a pair of L-shaped fixing members 43 are horizontally secured to the opposite inner walls 3*a* and 3*b* of the cooling unit section 3 generally above the refrigeration unit 10. The brine tank 11 is mounted on the pair of L-shaped fixing members 43 and is secured thereto by means of bolts 44. The task of the brine tank 11 is to cool brine 12 by refrigerant from the refrigeration unit 10 and to circulate the cooled brine 12 through a cooler 2 within the storage room 1*a*.

The brine tank 11 is composed of an outer casing 19 and an inner casing 20 with heat insulating material 21 filled therebetween. The upper rectangular opening of the tank 11 is removably covered by a lid 25 which is composed of an upper plate 22 and an inner plate 23 with heat insulating material 24 interposed therebetween. The four edges of the upper plate 22 are bent at right angles to fit over the outer casing 19 of the tank 11 so that the upper edges 26 of the tank 11 closely contact the inner plate 23. In addition, the bent edges of the upper plate 22 are secured to the outer casing 19 by means of bolts 27.

Extending through the lower side wall portion of the tank inner casing 20 is an inlet pipe 17 having one end exposed to the interior of the tank 11 and the other end connected to a brine circulating pump 14 secured to one of the fixing members 43. The pump 14 has a discharge pipe 18 which is connected in flow communication with a supply pipe 15 connected to the cooler 2 in the storage room 1*a* (FIG. 1). In addition, extending through the upper side wall portion of the tank inner casing 20 generally above the inlet pipe 17 is a discharge pipe 28 having one end bent downwardly and the other end connected with one end of a return pipe 29. The other end of the return pipe 29 is connected with a feedback pipe 16 (FIG. 1). It will be noted that the discharge pipes 18 and 28, the return pipe 29 and the inlet pipe 17 are covered with heat insulating hoses 30.

A pair of L-shaped support plates 31 are secured to the bottom 20*a* of the inner casing 20 in the tank 11 through bolts 32. An evaporator 13 is provided around the support plates 31 in coiled configuration so as to cool the brine 12 stored in the tank 11 to a required temperature. The bolt extending regions of the tank bottom 20*a* are sealed by screw stays 33 so as to prevent the brine 12 from leaking out of the tank 11.

The evaporator 13 has an outlet pipe 13*b* disposed generally disposed obliquely upwardly to which is connected one end of an accumulator 8. The other end of the accumulator 8 is connected to the inlet pipe 9 which in turn is connected to the refrigeration unit 10. Specifically, the accumulator 8 is located obliquely inwardly of the wound portion of the coil-shaped evaporator 13 immersed in the brine 12. As a result, the accumulator 8 is immersed entirely below the liquid level 12*a* of the brine 12. The task of the accumulator 8 is to prevent liquefied refrigerant which has not been fully evaporated by the evaporator 13 from being directly drawn into the compressor 4 and thence its cylinder to possibly damage the internal structures such as a valve. The accumulator 8 has a capacity for a reservoir and is conveniently operable to separate the vapor and liquid phase refrigerant flowing therein and deliver only the vapor phase refrigerant to the compressor 4.

As mentioned above, the accumulator 8 is disposed obliquely in the tank 11. The basis for this specific arrangement of the accumulator 8 is as follows. A part of the machine oil filled in the compressor 4 for lubricating movable parts in discharged from the compressor 4 together with the refrigerant, circulates through the refrigeration circuit and flows into the evaporator 13. Thus, the inclined accumulator 8 will facilitate returning of the machine oil to the compressor 4 with the vapor phase refrigerant. It is to be understood that the form, arrangement and details of construction of the accumulator 8 are not limited to the preferred embodiment of the invention. For example, a part of the accumulator 8 may be exposed above the liquid level 12*a* of the brine 12. In that instance, however, the accumulator 8 should also be inclined in view of the return of the above-mentioned machine oil.

Figure 3:
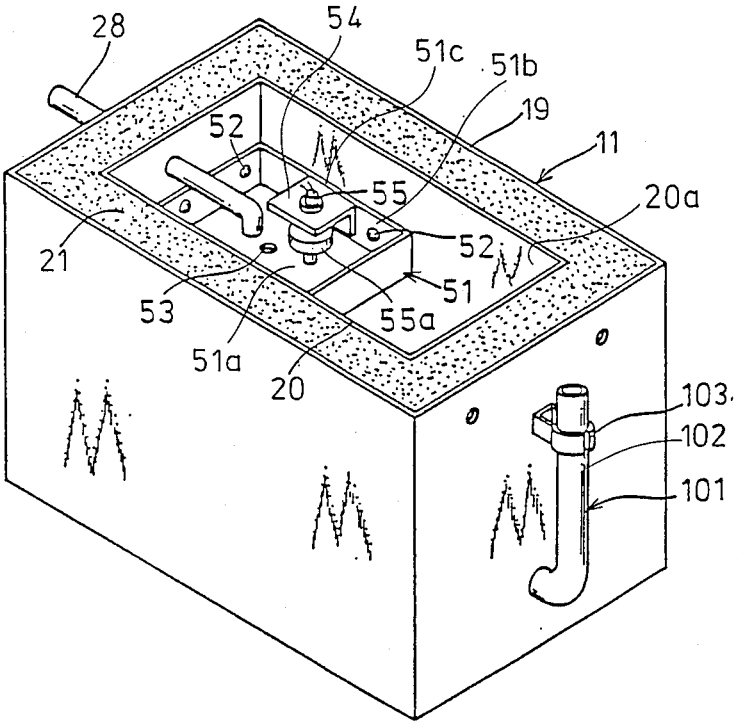
FIG. 3 is a schematic perspective view showing a brine tank with its lid removed.

With continuing reference to FIG. 2, a brine sensing tank 51 is provided and is secured to the side wall 20*b* of the inner casing 20 through bolts 52. The brine sensing tank 51 serves to sense the presence of brine circulation and is conveniently located in the middle position (above the predetermined level of the stored brine) within the brine tank 11. As best shown in FIG. 3, the brine sensing tank 51 is composed of a casing having an open top, its bottom 51*a* having a liquid drain hole 53 formed therein. The drain hole 53 is sized to permit only a small amount of brine to pass therethrough in comparison with the amount of brine flowing from the discharge pipe 28 to the sensing tank 51. By virtue of this arrangement, a part of the brine supplied from the discharge pipe 28 flows down into the brine tank 11, and the greater part of the brine is stored in the sensing tank 51. The brine 12 overflows from the upper side edge 51*c* of the sensing tank 51, and ultimately flows down into the brine tank 11.

The sensing tank 51 has an L-shaped mounting plate 54 secured to the side wall 51*b* thereof. The L-shaped mounting plate 54 is provided on its horizontally extending portion with means for sensing the varying level of the brine 12, such as, for example, a float switch 55 with a float 55*a*. Thus, when the amount of brine 12 in the sensing tank 51 is reduced, the float 55*a* is lowered thereby turning off the float switch 55. Conversely, when the brine 12 fills the sensing tank 51 and overflows therefrom, the float 55*a* is raised thereby turning on the float switch 55. Although the preferred embodiment utilizes a float switch, it is to be noted that other types of switches could be utilized. For example, these switches could be an electrode-operated switch, a pressure-operated switch or a mechanically-operated switch.

As shown in FIGS. 2 and 3, the brine tank 11 conveniently includes a level gauge 101 in the form of a communicating pipe, so that the brine level in the tank 11 may be visually inspected from outside. The level gauge 101 uses a flexible tubular body (hose) 102 of a plastic material which is transparent and free from deterioration in cold environments. The lower end of the tubular body 102 is connected in flow communication with the side wall of the brine tank 11. The tubular body 102 extends vertically outside the tank 11 and is fixedly supported by a fixing piece 103. The upper end of the level gauge 101 has a cap 104 with a through hole formed therein. As shown in FIG. 2, the cover 42 of the cooling unit section 3 has a rectangular inspection window 100 through which the level gauge 101 is visible when the cover 42 is mounted to the cooling unit section 3. By means of the level gauge 101, visual inspection may readily be performed from outside to see if the brine is present in the tank 11 or if the desired amount of brine is stored in the tank 11. Further, by removing the level gauge 101 from the tank 11, the brine 12 in the tank 11 may conveniently be discharged. It is to be noted that above the brine tank 11, the cooling unit section 3 has removably mounted thereto an electrical attachment box 45 which includes an internal temperature regulator, an unusual condition warning lamp and other electrical attachments.

Figure 4:
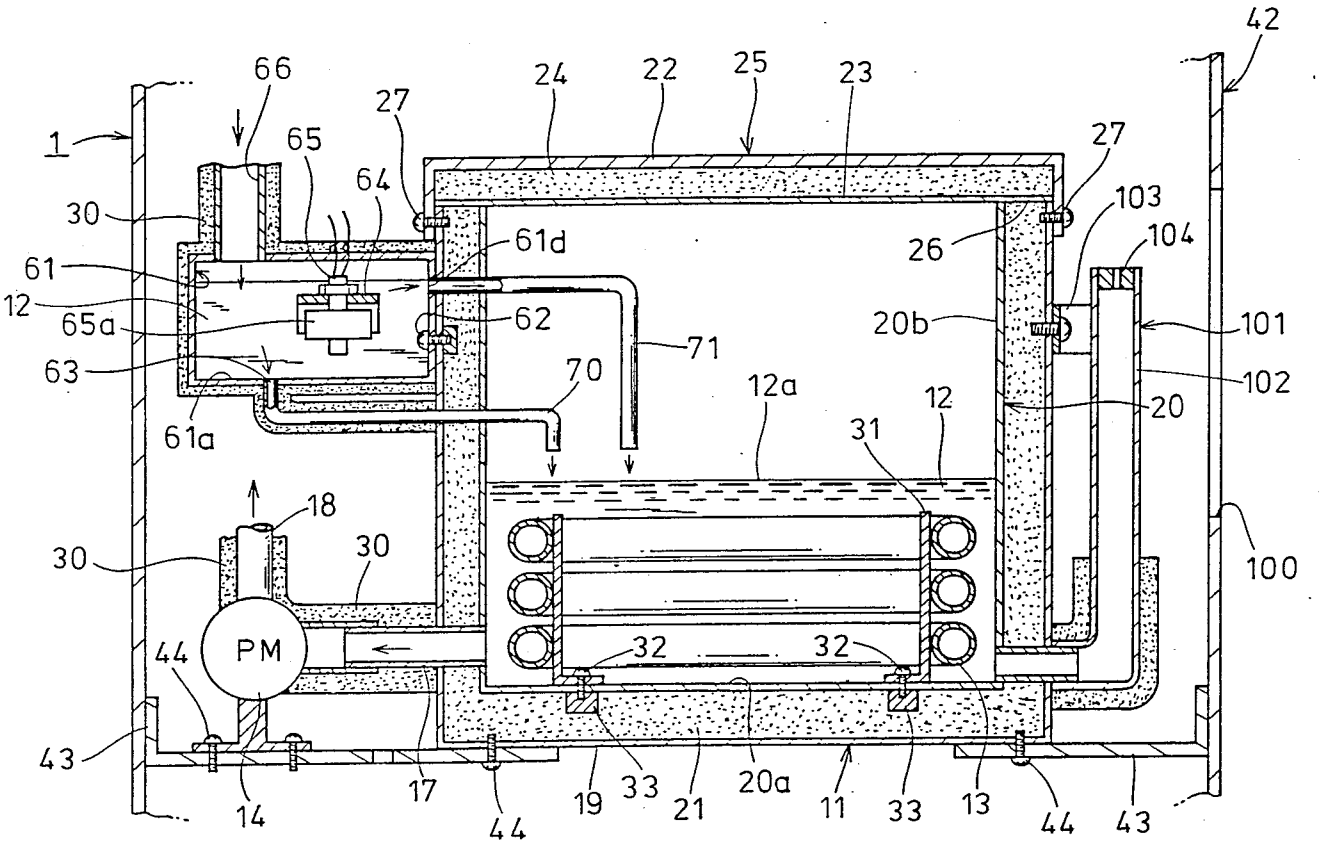
FIG. 4 is a vertical sectional view showing a modification to the brine circulation sensing device shown in FIG. 2.

FIG. 4 shows a modification of the brine sensing device 51 shown in FIG. 2. In the modification shown in FIG. 4, a brine sensing device 61 is provided outside the brine tank 11 whereas in the arrangement shown in FIG. 2 the sensing device 51 is provided inside the tank 11. Specifically, the brine sensing tank 61 is composed of a casing which is closed on its top with a cover to define a sealed space therein. The sensing tank 61 is secured to the outer wall of the brine tank 11 through bolts 62. Connected to the closed top of the sensing tank 61 is a discharge pipe 66 communicating with the feedback pipe 16 of the cooler 2, so that the returning brine 12 may be fed back to the sensing tank 61 through the discharge pipe 66. The sensing tank 61 has on its bottom 61*a* a liquid drain hole 63 which in turn has connected thereto a drain pipe 70 with an opening located above the brine tank 11, as shown in FIG. 4. It is to be noted that the drain hole 63 is sized to permit only a small amount of brine to pass therethrough in comparison with the amount of brine flowing from the discharge pipe 66 to the sensing tank 61.

The brine sensing tank 61 also has on its side wall an aperture 61*d* through which the brine 12 is overflown outwardly of the tank 61 when a predetermined level is reached of the brine flowing into the tank through the discharge pipe 66. An overflow pipe 71 is connected to the aperture 61*d* having an opening located above the brine tank 11, as shown in FIG. 4. The sensing tank 61 has a mounting plate 64 secured to the side wall thereof. A float switch 65 with a float 65*a* is mounted on the mounting plate 64 and is adapted to sense the varying level of the brine 12. Thus, when the amount of brine 12 in the sensing tank 61 is reduced, the float 65*a* is lowered thereby turning off the float switch 65. Conversely, when the brine 12 fills the sensing tank 61 and overflows therefrom, the float 65*a* is raised thereby turning on the float switch 65. As may be appreciated from the embodiment of FIG. 4, the sensing device may not be necessarily mounted within the brine tank 11, so long as it is associated with the brine circulation pipeline.

Turning to FIG. 1, the cooler 2, through which the brine 12 is fed and circulated, is mounted on the right side inner wall of the storage room 1*a*. The cooler 2 is preferably of fin and tube type but a plate type cooler may be used. A cooling duct 35 having a closed top and an open bottom is provided to cover the cooler 2 in non-contacting manner. Air is drawn from underside of the cooling duct 35 and exchanges heat with the cooler 2. The cooling duct 35 has an opening 36 through which the air cooled by the cooler 2 is blown by a fan motor FM1 and is circulated through the storage room la in the direction of arrows. In addition, a defrosting thermostat Th2 for sensing completion of defrosting operation and a defrost-accelerating heater H are provided adjacent the cooler 2. Disposed below the cooler 2 is a dew receptacle 37 serving to collect water droplets from the cooler 2 during defrosting operation and to discharge the same out of the storage room 1*a*. An internal thermostat Th1 is located at a suitable position in the storage room 1*a* and is operable to close contacts in an electrical circuit system which will be hereinafter described, when the upper set limit of the internal temperature is reached.

In the refrigeration pipeline and the brine circulation pipeline shown in FIG. 1, the vaporized refrigerant compressed by the compressor 4 is liquefied by the condenser 5, dehumidified by the drier 6 and then passed through the solenoid valve V1. The liquefied refrigerant is then decompressed to a required value by the capillary tube 7 serving as decompression means, and is vaporized by the evaporator 13 in the brine tank 11 where heat is exchanged with the brine 12 to cool the same. The vapor phase refrigerant vaporized in the evaporator 13 and the liquid phase refrigerant not vaporized in the evaporator 13 flow into the accumulator 8 where the mixed vapor-liquid phase refrigerant is separated into vapor phase refrigerant and a liquid phase refrigerant. The vapor phase refrigerant is fed back to the compressor 4 through the inlet pipe 9, and the liquid phase refrigerant is stored in the accumulator 8.

Next, the brine circulation circuit will be described. The brine 12 stored in the brine tank 11 is cooled to a required temperature by the evaporator 13 connected to the refrigeration unit 10, and is drawn by the circulating pump 14 through the inlet pipe 17 extending from the tank 11. The brine 12 is then fed to the cooler 2 in the storage room la through the outlet pipe 18 and the supply pipe 15, and the heat of the brine 12 is exchanged in the cooler 2 with the air in the storage room 1*a*. The brine 12 is returned through the feedback pipe 16 and the discharge pipe 28 (or 66 in the embodiment of FIG. 4) to the brine sensing tank 51 (or 61 in the embodiment of FIG. 4). As mentioned above, a part of the brine 12 fed back to the sensing tank 51(61) flows through the drain hole 53 (in the embodiment of FIG. 4, through the drain pipe 70) into the brine tank 11, and the rest of the brine 12 overflows from the upper side edge 51*c* of the sensing tank 51 (in the embodiment of FIG. 4, through the overflow pipe 71) into the brine tank 11. When the liquid level of the sensing tank 51(61) rises, the float switch 55(65) will be turned on.

Figure 5:
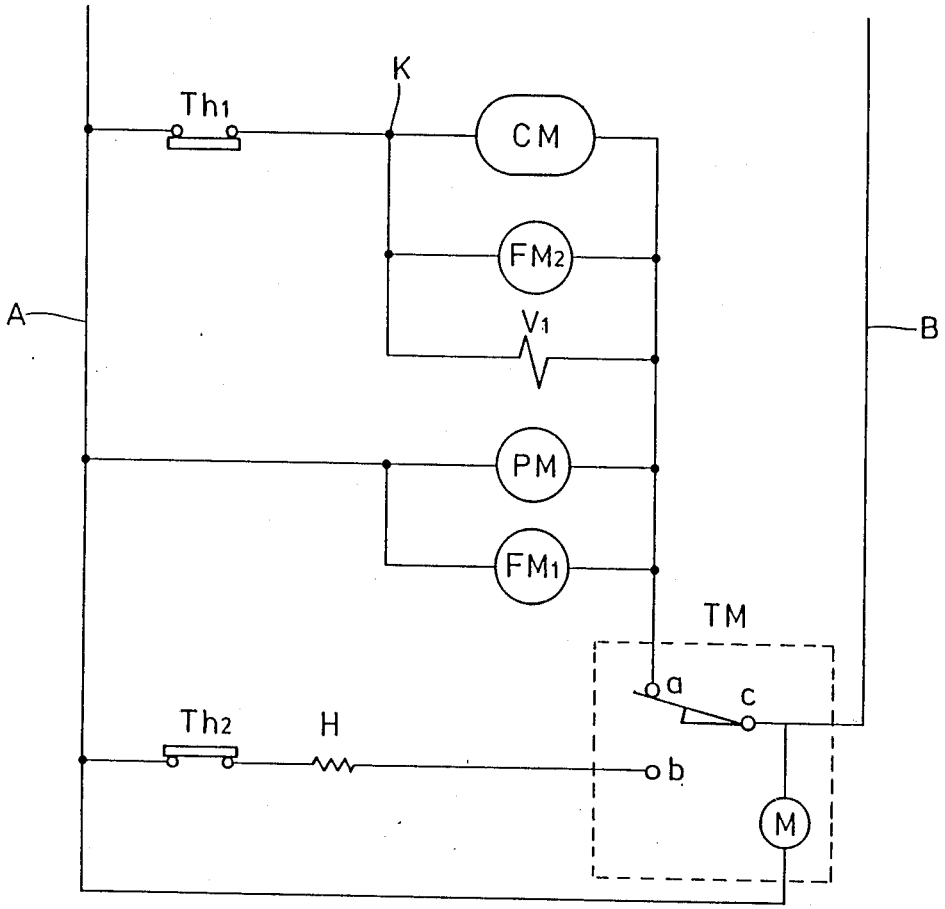
FIG. 5 is a schematic diagram of an electrical control circuit for the thermo-hygrostatic refrigerator of the invention.
Figure 6:
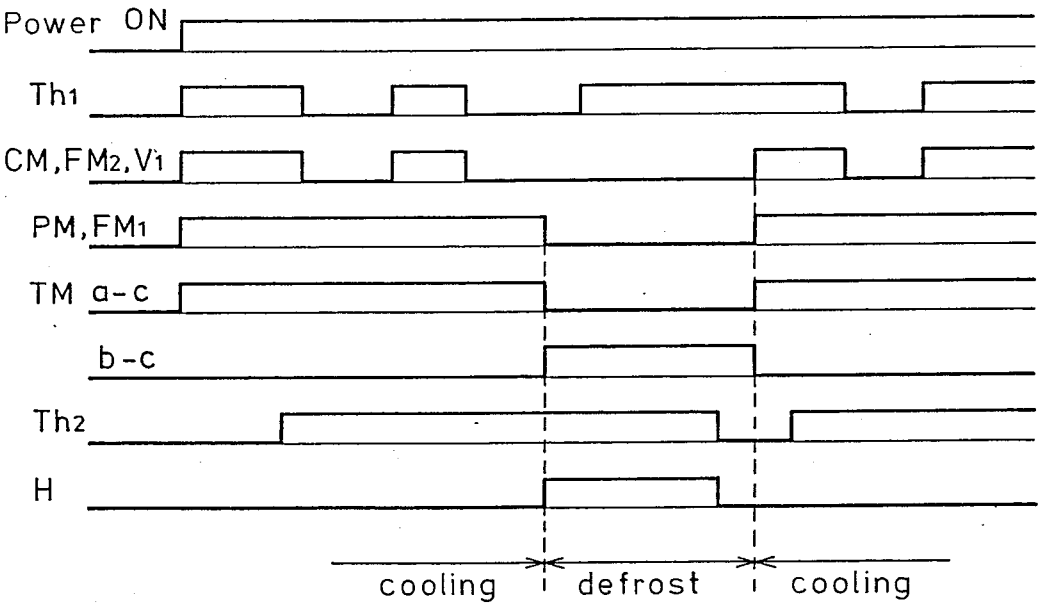
FIG. 6 is a time chart illustrating the operation of the electrical control circuit shown in FIG. 5.

FIG. 5 shows an electrical control circuit for the thermo-hygrostatic refrigerator of the invention. As shown therein, a cam timer TM is connected between power supply lines A and B. The cam timer TM has a movable contact c on the power supply line B. During cooling cycle, the movable contact c is connected to a fixed contact a by a timer driving motor M, and during defrosting cycle, the movable contact c is shifted to a fixed contact b. The thermostat Th1 is connected between the power supply line A and a connecting point K, and the compressor CM(4), the fan motor FM2 and the solenoid valve V1 are connected in parallel between the connecting point K and the fixed contact a. The thermostat Th1 is opened until the internal temperature is increased to exceed an upper set limit, and is closed upon exceeding the upper set limit. Conversely, the thermostat Th1 is closed until the internal temperature is lowered to exceed a lower set limit, and is opened upon exceeding the lower set limit. Further, when the solenoid valve V1 is energized, it is opened to release the pipeline, and when power to the solenoid valve V1 is disconnected, it is closed to shut off the pipeline. Further, the pumpmotor PM(14) and the fan motor FM1 are connected in parallel between the power supply line A and the fixed contact a. The defrosting thermostat Th2 and the heater H are connected in series between the power supply line A and the fixed contact b. The defrosting thermostat Th2 is closed when the temperature of the cooler 2 falls below a predetermined value.

The operation of the thermo-hygrostatic refrigerator of the invention will now be described with reference to FIGS. 1, 2, 5 and 6. Prior to operating the refrigerator, the front cover 42 of the cooling unit section 3 is removed and the electrical attachment box 45 is drawn outwardly. The lid 25 of the brine tank 11 is then removed to open the tank 11. Brine 12 is put into the brine tank 11. The input amount of brine is the sum of the volume to be allowed in the brine circulation pipeline and the amount to be stored in the brine tank 11 at a proper liquid level. After the brine 12 has been put in the tank 11, the lid 25 is mounted again and the electrical attachment box 45 is inserted in place. The front cover 42 is mounted on the cooling unit section 3.

When power is turned on, the contacts a and c of the cam timer TM are connected to initiate a cooling cycle. At this time, the temperature in the storage room 1*a* is high and hence, the thermostat Th1 is in its closed position. The solenoid valve V1 is opened to communicate the drier 6 with the capillary tube 7, and the compressor 4 and the condenser fan motor FM2 are started to operate the cooling system. Further, the pump 14 for brine circulation is driven so that the brine 12 stored in the tank 11 is drawn through the inlet pipe 17 and is fed to the cooler 2 through the outlet pipe 18 and the supply pipe 15.

The brine 12 fed under pressure by the pump 14 passes through the cooler 2 where it exchanges heat with the air in the storage room la. The brine 12 is then returned to the tank 11 through the feedback pipe 16 and the discharge pipe 28. The returned brine 12 is mixed with the stored brine 12 cooled by the evaporator 13 in the tank 11, and is again circulated through the inlet pipe 17 and the pump 14. By repeating the cycle, the temperature in the storage room la is gradually lowered.

When the internal temperature falls below the lower set limit, the thermostat Th1 is opened. As soon as this occurs, the compressor 4 and the fan motor FM2 are stopped thereby closing the solenoid valve V1. However, since the pump 14 continues to run, the brine 12 in the tank 11 continue to circulate in the pipeline. During the brine circulation, the temperature of the brine 12 is raised by external heat entering the storage room, as discussed in the "Description of the Prior Art". In the present invention, however, the accumulator 8 is wholly or at least partially immersed in the brine 12 and hence, as the liquefied refrigerant stored in the accumulator 8 evaporates, it removes evaporation heat from the brine 12 through an outer wall 8*a* of the accumulator 8. As the result, the brine 12 is maintained for a while at the temperature where the refrigeration unit 10 has been shut down. This means that the interval for the refrigeration unit 10 to initiate its cooling cycle is prolonged that much. Thereafter, the temperature of the brine 12 is gradually increased by various factors such as reduction in evaporation heat value due to increased saturation temperature of refrigerant caused by pressure increase in the cooling circuit, and reduction of liquid phase refrigerant in the accumulator 8.

The internal temperature is raised by the increased temperature of the brine 12 and various heats from outside of the storage room, and when the internal temperature exceeds the upper set limit, the thermostat Th1 is closed. As soon as this occurs, the compressor 4 and the fan motor FM2 are started and the solenoid valve V1 is closed, thereby resuming the operation of the refrigeration unit 10. The internal temperature at this point is substantially equal to the temperature of the brine 12, and the liquid phase refrigerant in the accumulator 8 is all in vaporized condition. By repeating the above cycle, the internal temperature is maintained between the upper and lower set limits.

When the defrost cycle is initiated, the connection of the movable contact c of the cam timer TM is shifted to the fixed contact b. At this time, the temperature of the cooler 2 is cool enough to maintain the defrosting thermostat Th2 in its closed position. The heater H is then energized to initiate a defrosting cycle. Upon completion of the defrosting cycle, the thermostat Th2 senses the condition and is opened thereby to cut off power to the heater H. After the defrost cycle has been completed, the connection of the cam timer TM is shifted to the contacts a and c, and the foregoing cooling cycle is resumed.

In the above described cooling cycle, when the refrigeration unit 10 is shut down, the solenoid valve V1 is opened and the inlet side piping of the capillary tube 7 is cut off. The basis of the specific operation is as follows. Without the solenoid valve V1, when the refrigeration unit 10 is shut down, the high pressure refrigerant on the discharge side of the compressor 4 will pass through the capillary tube 7 and flow through the evaporator 13 into the accumulator 8, thereby causing the pressure of refrigerant in the accumulator to rise in a short period of time. As this occurs, the evaporation temperature of the refrigerant in the accumulator 8 becomes high, thereby diminishing its action to remove evaporation heat from the brine 12. For this reason, the solenoid valve V1 is provided and is adapted to be closed upon stopping of the refrigeration unit 10. In addition, when electrical power fails, the solenoid valve V1 is closed thereby preventing damage to the compressor 4 and other components. Specifically, with the solenoid valve V1 in its open position the high pressure refrigerant is caused to flow through the capillary tube 7 into the evaporator 13 and the accumulator 8 where it is condensed into a great amount of liquid phase refrigerant. When the refrigeration unit 10 is restarted, the great amount of liquid phase refrigerant stored in the evaporator 13 and the accumulator 8 is drawn through the inlet pipe 9 into the compressor 4, and liquid compression might be effected causing valve cracking and other damage. Thus, in the event of power failure, the solenoid valve V1 is closed preventing such damage.

The operation of the brine sensing device 51 will now be described. When power is turned on, the compressor 4 and the condenser fan motor FM2 are started to operate the cooling system. Further, the pump 14 for brine circulation is driven so that the brine 12 stored in the tank 11 is drawn through the inlet pipe 17 and is fed to the cooler 2 through the outlet pipe 18 and the supply pipe 15. At this point, in the brine sensing tank 51 disposed in the tank 11, the brine 12 has not yet been delivered from the cooler 2 through the discharge pipe 28 and therefore, the float 55*a* of the float switch 55 is located in its lowered position, its contacts being in an open position.

The brine, fed under pressure from the pump 14 and passed through the cooler 2, initiates to flow from the feedback pipe 16, passes through the discharge pipe 28 and down into the brine sensing tank 51. At this point, as mentioned above, the amount of the outflowing brine 12 through the liquid drain hole 53 in the bottom 51*a* of the tank 51 is set to be smaller than that of the brine 12 flowing into the tank 51 through the discharge pipe 28. Consequently, only a part of the delivered brine 12 flow down into the brine tank 11 through the drain hole 53, and the greater part of the brine 12 is stored in the sensing tank 51, thus gradually raising the liquid level thereof. Because of the raised liquid level, the brine 12 will ultimately be overflown from the upper side edge 51*c* of the sensing tank 51 down into the brine tank 11. The float 55*a* of the float switch 55 is caused to float with the rise of liquid level, thereby closing its contacts.

One of the important features of the present invention is the specific operation when the cooling has become impossible in the cooler 2. For example, wear resistance of bearings for rotating parts used in the brine circulating pump 14 is rated only at about 10,000 to 20,000 hours. Therefore, in case of failure of rotating parts of the pump 14 or during periodical replacement work, the brine circulation has to be interrupted. In addition, when motor coils are broken or when rotational pressure-boosting parts are damaged, the brine circulation may not be effected. Further, the brine can leak from connections in the circulation circuit, reducing the amount of brine.

If brine circulation is interrupted, for example, by faulty bearings of the pump 14, the brine will not flow through the discharge pipe 28 into the sensing tank 51. Consequently, the level of the brine in the sensing tank 51 is gradually lowered until the float switch 55 will be turned off to open its contacts. As this occurs, the solenoid valve V1 is closed thereby interrupting the refrigerant supply to the evaporator 13 in the brine tank 11 and stopping rotation of the fan motor FM1. In addition, warning means such as lamps and buzzers may be provided, as necessary, and actuated in response to open contacts of the float switch 55. It is to be noted that the above result may be attained likewise in the modified sensing device 61 which is located outside of the brine tank 11.

Although the preferred embodiment has been described in relation to the use of a single brine circulation circuit system, it will be appreciated that the invention may be applied to a refrigerator having a plurality of brine circulation circuit systems. In addition, the refrigerator of the present invention may be applied not only to refrigerators of the type wherein the refrigeration unit is arranged adjacent the storage room but also to refrigerators of the so-called separate type wherein supply and feedback pipes are connected through hoses. Further, the configuration of the storage room must not necessarily be horizontal. Rather, it may have other shapes such as vertical shape. Moreover, the present invention may be conveniently used for refrigerators wherein in addition to the main cooler 2, an auxiliary cooler is provided in the storage room to circulate refrigerant from the refrigeration unit 10. Thus, if the main cooler 2 becomes inoperative due to improper brine circulation, the contacts of the float switch 55 will be opened to thereby change over the solenoid valve V1. The supply of the refrigerant to the evaporator 13 in the accumulator 8 will then be cut off, initiating supply of refrigerant to the auxiliary cooler to continue the cooling operation in the storage room.

The accumulator may have various configurations, and the volume and other factors of the accumulator may be freely determined. Further, in addition to common forms of refrigerators, the present invention is applicable to cooling apparatus wherein a tubular body is immersed in a brine tank and liquids, such as juice and other refreshing drinks, are passed through and cooled in the tubular body.

From the foregoing detailed description, it can be appreciated that the thermo-hygrostatic refrigerator of the invention offers the possibility of setting shutdown time of the refrigeration unit relatively longer and of reducing the amount of brine to be stored in the brine tank. Therefore, frequent starting and stopping of driving parts of the compressor and other components may be reduced, thereby prolonging service life of the refrigerator and minimizing power consumption. In addition, there is no need to provide a larger brine tank and hence, with equal cooling capacity, the external dimensions of the refrigerator may be reduced and the capacity to store food materials may be increased. All of these factors may lead to reduced manufacturing cost.

Further, it the cooler becomes unable to cool the interior of the storage room from troubles such as failure of pump, the brine circulation sensing device will rapidly be actuated to positively sense the interruption of brine circulation. In addition, since the brine sensing device is located in the brine tank, the sensing means typified by the float switch is substantially as cold as the brine. Therefore, the construction of the sensing means will not be deteriorated due to possible dew produced on the sensing means, thus reducing the possibility of malfunction and failure and increasing the reliability of the sensing means. The sensing device itself may be mounted within the brine tank making it possible to utilize the mounting space.

Finally, warning means such as lamps and buzzers may be provided in association with the sensing device and actuated by an output signal therefrom, so that any possible prolonged rise of the internal temperature may be precluded, thereby effectively preventing the stored food materials from being deteriorated or rotten.

What is claimed is:

1. A thermo-hygrostatic refrigerator comprising a storage room for cooling and storing food materials therein, a refrigeration unit including a compressor for coolant, a condenser, a decompression means and an evaporator installed in a brine tank and other refrigeration systems, said brine tank cooling brine stored therein by said evaporator, and a cooler which circulates said brine by a pump to cool the interior of said storage room, said refrigerator being characterized in that:

an outlet section of said evaporator disposed inside of said brine tank is positioned at the bottom of said brine tank, and an accumulator connected to outlet side of said compressor is disposed obliquely at the outlet section of said evaporator so that said accumulator is entirely immersed in said brine stored in said brine tank;

a brine sensing means is relatively connected to said brine tank, said brine sensing means including a sensing tank which collects brine returning from said cooler, a level sensing switch which is disposed in said sensing tank and senses the varying level of said brine, and a drain hole which is formed in the bottom of said sensing tank and communicates to said brine tank so that said drain hole permits a smaller amount of brine compared to the amount of said brine returning to said sensing tank to return to said brine tank; and a solenoid valve is disposed in a pipeline system connecting said compressor and decompression means, said solenoid valve being opened and closed in synchronism with the starting and stopping of said refrigerator unit, and said level sensing switch senses the stop of decrease of the flow of said brine returning from said cooler to said sensing tank so that said solenoid valve is closed to prevent coolant from flowing from said compressor into said decompression means

2. The refrigerator as defined in claim 1 wherein said sensing means comprises an electrode switch.

3. The refrigerator as defined in claim 1 wherein said sensing means comprises a pressure switch.

4. The refrigerator as defined in claim 1 wherein said sensing means comprises a microswitch.

5. The refrigerator as defined in claim 1 wherein said sensing means comprises an electrode switch.

6. The refrigerator as defined in claim 1 wherein said sensing means comprises a pressure switch.

7. The refrigerator as defined in claim 1 wherein said sensing means comprises a microswitch.

* * * * *